US006851773B2

(12) United States Patent
Chen et al.

(10) Patent No.: US 6,851,773 B2
(45) Date of Patent: Feb. 8, 2005

(54) RETAINING STRUCTURE FOR A SLIDE-AIDING MEMBER OF A TRACK DEVICE FOR A DRAWER

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/413,480

(22) Filed: Apr. 15, 2003

(65) Prior Publication Data

US 2004/0207301 A1 Oct. 21, 2004

(51) Int. Cl.[7] ..... A47B 88/16
(52) U.S. Cl. ..... 312/334.46; 312/333
(58) Field of Search ..... 312/334.1, 334.7, 312/334.44, 334.46, 334.11, 334.17, 330.1, 334.8, 334.9, 334.38, 334.47

(56) References Cited

U.S. PATENT DOCUMENTS 5,577,821 A * 11/1996 Chu ..... 312/334.11
6,367,899 B1 * 4/2002 Hwang et al. ..... 312/334.47
6,375,290 B1 * 4/2002 Lin et al. ..... 312/334.46
6,457,790 B1 * 10/2002 Liang et al. ..... 312/334.46
6,464,311 B2 * 10/2002 Liang et al. ..... 312/334.46
2003/0178922 A1 * 9/2003 Chen et al. ..... 312/334.44

FOREIGN PATENT DOCUMENTS

JP 04096711 A * 3/1992 ..... A47B/88/10

* cited by examiner

*Primary Examiner*—Peter M. Cuomo
*Assistant Examiner*—Stephanie Harris
(74) *Attorney, Agent, or Firm*—Bacon & Thomas, PLLC

(57) ABSTRACT

A track device includes a first track, a second track slidably received in the first track, and a slide-aiding member mounted between the first track and the second track. A retaining member is securely mounted on a front end of the first track and includes a resilient hook rod. When the second track is removed from the first track, the resilient hook rod of the retaining member is engaged with an engaging notch in a front end of the slide-aiding member, thereby retaining the slide-aiding member in place. When the second track is reinserted into the slide-aiding member and the first track, an unlatching member on the second track urges the resilient hook rod of the retaining member to disengage from the engaging notch of the slide-aiding member, allowing further inward sliding movement of the second track into the first track.

11 Claims, 6 Drawing Sheets

RETAINING STRUCTURE FOR A SLIDE-AIDING MEMBER OF A TRACK DEVICE FOR A DRAWER

BACKGROUND OF THE INVENTION

1. Field of the Invention

The present invention relates to a retaining structure for a slide-aiding member of a track device consisting of at least a first track and a second track, wherein the slide-aiding member is retained in place by the retaining structure after the second track is removed from the first track of the track device and wherein the second track can be precisely and rapidly reinserted into the first track.

2. Description of Related Art

A typical conventional track device for a drawer is shown in FIG. 1 and includes at least a first track 10 and a second track 20. A slide-aiding member 30 is provided between the first track 10 and the second track 20, allowing smooth sliding movement of the second track 20. The first track 10 further includes a stop 101 on a front end (left end in FIG. 1) to prevent the slide-aiding member 30 from being disengaged from the first track 10. Nevertheless, when a user is intended to detach the drawer from furniture such as a cabinet by means of pulling the second track 20 out of the first track 10, the first track 10 is unable to retain the slide-aiding member 30 that slides outward along with the second track 20. Thus, it is difficult to precisely reinsert a rear end (right end in FIG. 1) of the second track 20 into a space between two lateral sides of the slide-aiding member 30 that would slide freely in the first track 10 during reinsertion of the second track 20. Further, the rear end of the second track 20 might impinge the front end of the slide-aiding member 30 and thus cause damage to the front end of the slide-aiding member 30 as well as falling of the balls of the slide-aiding member 30. The utility of the track device is limited and the life of the track device is shortened.

OBJECTS OF THE INVENTION

An object of the present invention is to provide a track device including a first track, a second track slidably received in the first track, and a slide-aiding member mounted between the first track and the second track, wherein a retaining member is fixed on the first track for retaining the slide-aiding member in place after the second track is removed from the first track.

Another object of the present invention is to provide a track device including a first track, a second track slidably received in the first track, and a slide-aiding member mounted between the first track and the second track, wherein the second track removed from the first track can be precisely reinserted into the first track and the slide-aiding member without causing damage to the slide-aiding member.

SUMMARY OF THE INVENTION

To achieve the aforementioned objects, the present invention provides a track device having a first track including a front end and a rear end, a second track slidably received in the first track, and a slide-aiding member mounted between the first track and the second track, allowing smooth sliding movement of the second track relative to the first track, the slide-aiding member including an engaging notch in a front end thereof. A retaining member is securely mounted on the front end of the first track and includes a resilient hook rod. An unlatching member is securely provided on the second track.

When the second track is removed from the first track, the resilient hook rod of the retaining member is engaged with the engaging notch of the slide-aiding member, thereby retaining the slide-aiding member in place. When the second track is reinserted into the slide-aiding member and the first track, the unlatching member urges the resilient hook rod of the retaining member to disengage from the engaging notch of the slide-aiding member, allowing further inward sliding movement of the second track into the first track.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
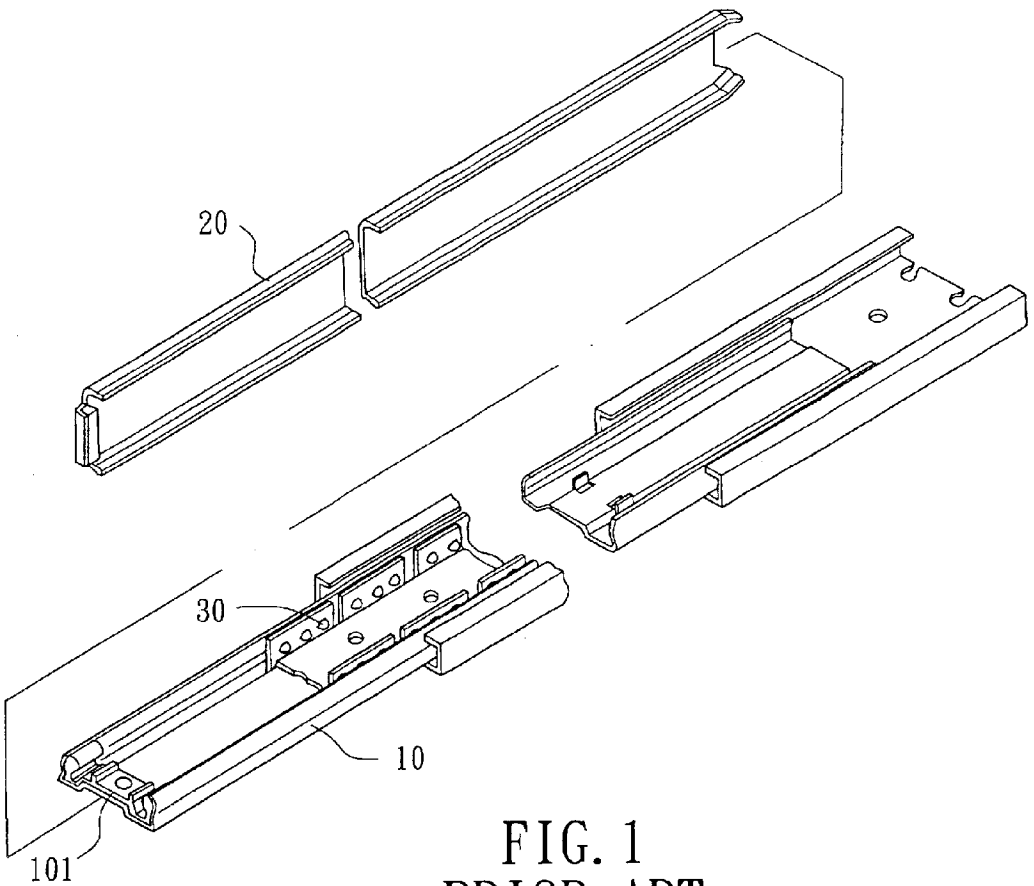
FIG. 1 PRIOR ART
FIG. 1 is a an exploded perspective view of a conventional track device for a drawer.

The present invention is now to be described hereinafter in detail, in which the same reference numerals are used for the same parts as those in the prior art.

Figure 2:
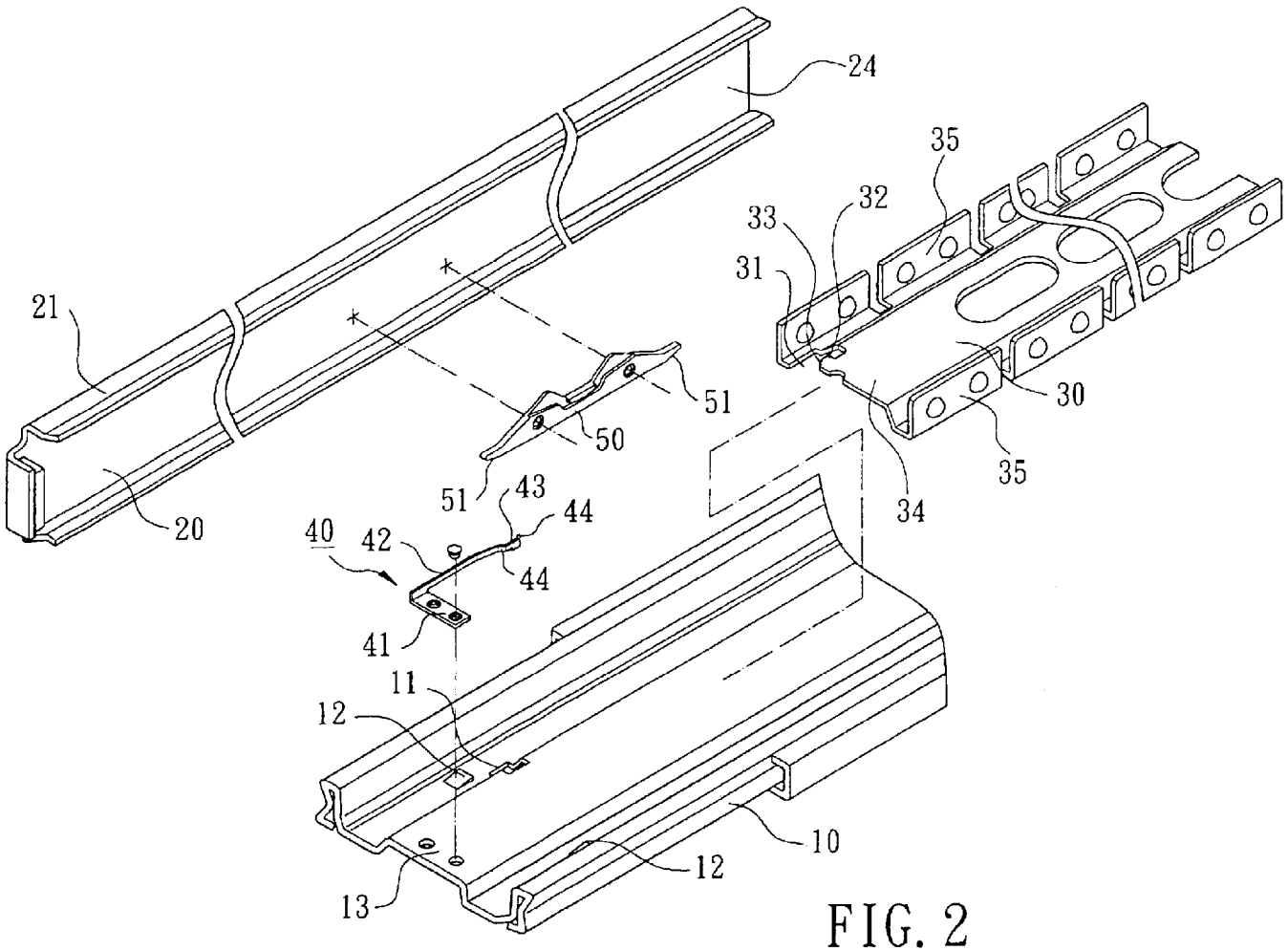
FIG. 2 is an exploded perspective view of a track device for a drawer in accordance with the present invention.
Figure 3:
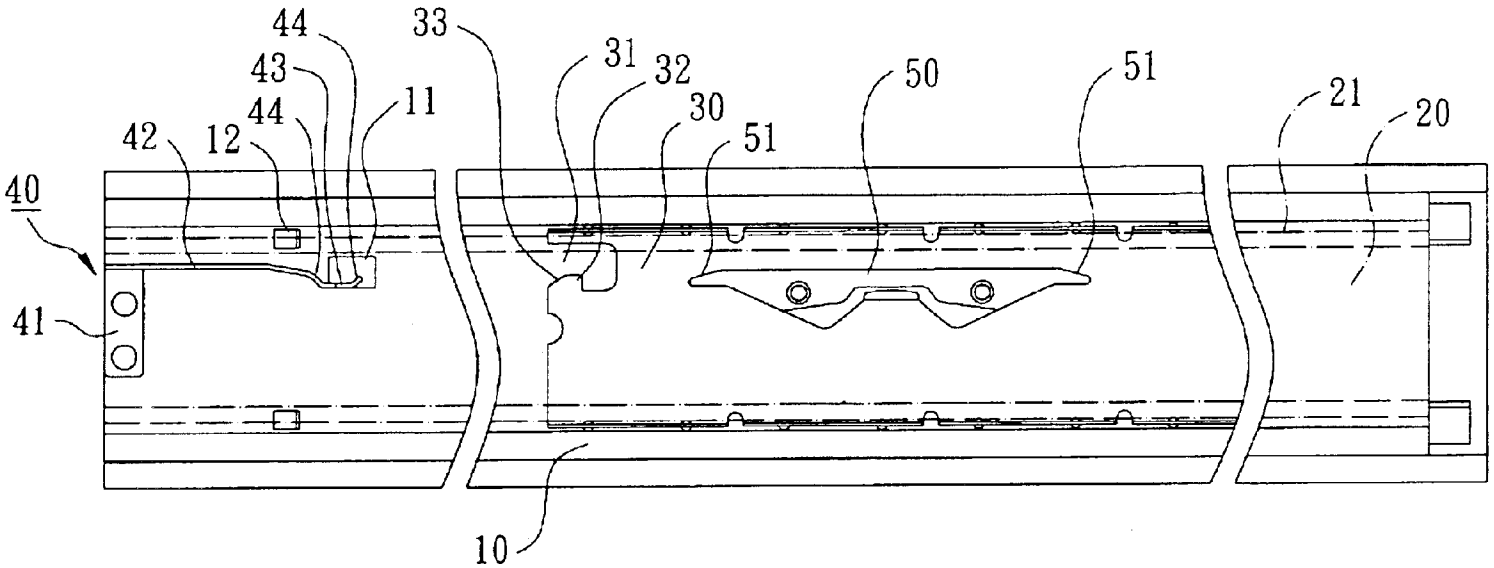
FIG. 3 is a plan view of the track device for a drawer in accordance with the present invention.

Referring to FIGS. 2 and 3, a track device for a drawer in accordance with the present invention includes at least a first track 10 and a second track 20. A slide-aiding member 30 is mounted between the first track 10 and the second track 20, allowing smooth sliding movement of the second track 20 relative to the first track 10.

A retaining member 40 is securely mounted to a front end of the first track 10 and is preferably a plate made of an impact-resistant material such as metal. In this embodiment, the retaining member 40 includes a base 41 and a resilient hook rod 42 extending rearward from an upper edge of the base 41 and having a hook 43 on a distal end thereof. The hook 43 has two slant guide faces 44 on two ends thereof, with the slant guide faces 44 facing away from each other. When the retaining member 40 is fixed to the first track 10, the hook 43 of the retaining member 40 extends into a slot 11 defined in an intermediate portion 13 of the first track 10, avoiding interference to the sliding movement of the second track 20 in the first track 10. Nevertheless, the slot 11 can be omitted if the hook 43 is located in a position not on the way of the second track 20.

The slide-aiding member 30 includes an engaging notch 31 in an intermediate portion 34 thereof to thereby define a hook 32. Preferably, the hook 32 includes a slant 33 on a front end thereof. Due to provision of the slant 33, the hook 43 of the retaining member 40 can be smoothly guided by the rear slant guide face 44 (i.e., the right one in FIG. 2) into the engaging notch 31 and securely engage with the hook 32 of the slide-aiding member 30 when the second track 20 is removed from the first track 10. Further, when the slide-aiding member 30 slides to the front end of the first track 10, a stop 12 on the intermediate portion 13 of the first track 10 prevents further outward movement of the slide-aiding member 30. Thus, falling of the slide-aiding member 30 from the first track 10 during removal of the second track 20 from the first track 10 is avoided.

Still referring to FIGS. 2 and 3, an unlatching member 50 is provided on the second track 20. In this embodiment, the unlatching member 50 is fixed to an intermediate portion 24 of the second track 20, spaced from the lateral walls 21 of the second track 20, and spaced from the rear end of the second track 20 by an appropriate distance. The unlatching member 50 includes two inclined faces 51 respectively on two ends thereof. Preferably, the inclined faces 51 face away from each other. When the second track 20 slides toward the front end of the first track 10, one of the inclined faces 51 of the unlatching member 50 imparts a force to the hook 43 of the retaining member 40, urging the hook 43 to disengage from the engaging notch 31 of the slide-aiding member 30. The retaining member 40 returns to its initial position by its resilience after the unlatching member 50 passes.

Figure 4:
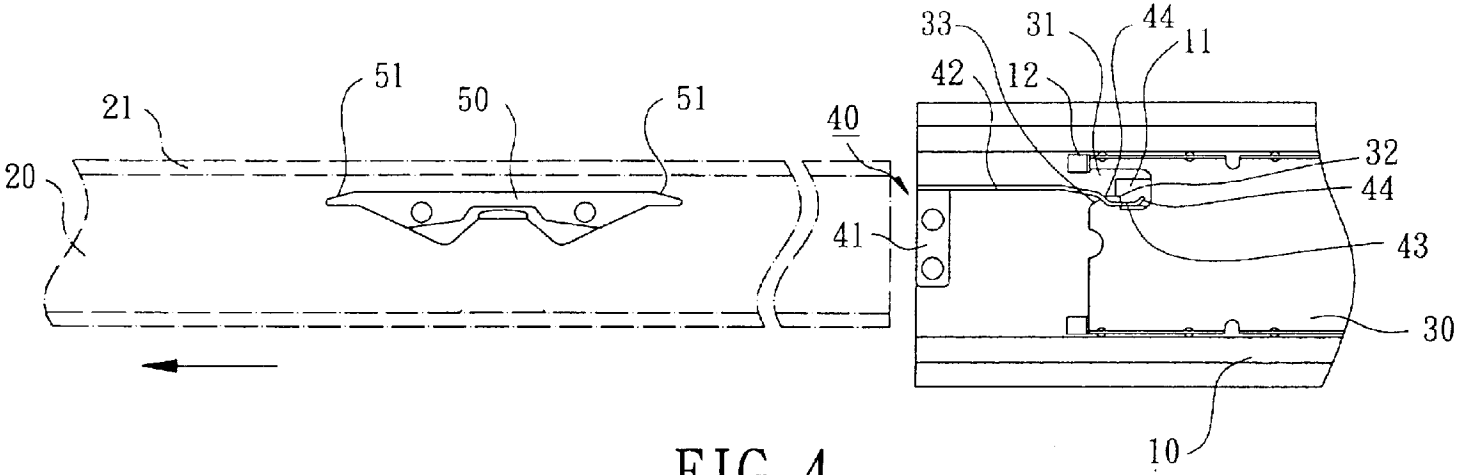
FIG. 4 is a view similar to FIG. 3, illustrating removal of a second track from a first track of the track device in accordance with the present invention.

Referring to FIGS. 3 and 4, when the user is intended to detach the drawer and thus pulls the second track 20 outward (forward) for disengaging the second track 20 from the first track 10, the slide-aiding member 30 slides forward along with the second track 20. The front inclined face 51 (the left one in FIG. 2) imparts a force to the hook 43 of the retaining member 40 and thus urges the hook 43 to disengage from the engaging notch 31 of the slide-aiding member 30, allowing the hook 43 to smoothly slide across the slant 33 of the slide-aiding member 30. Then, the hook 43 of the retaining member 40 returns to its initial position and thus engages with the hook 32 of the slide-aiding member 30. Accordingly, the slide-aiding member 30 is retained in place by the retaining member 40 after the second track 20 is removed.

Figure 5:
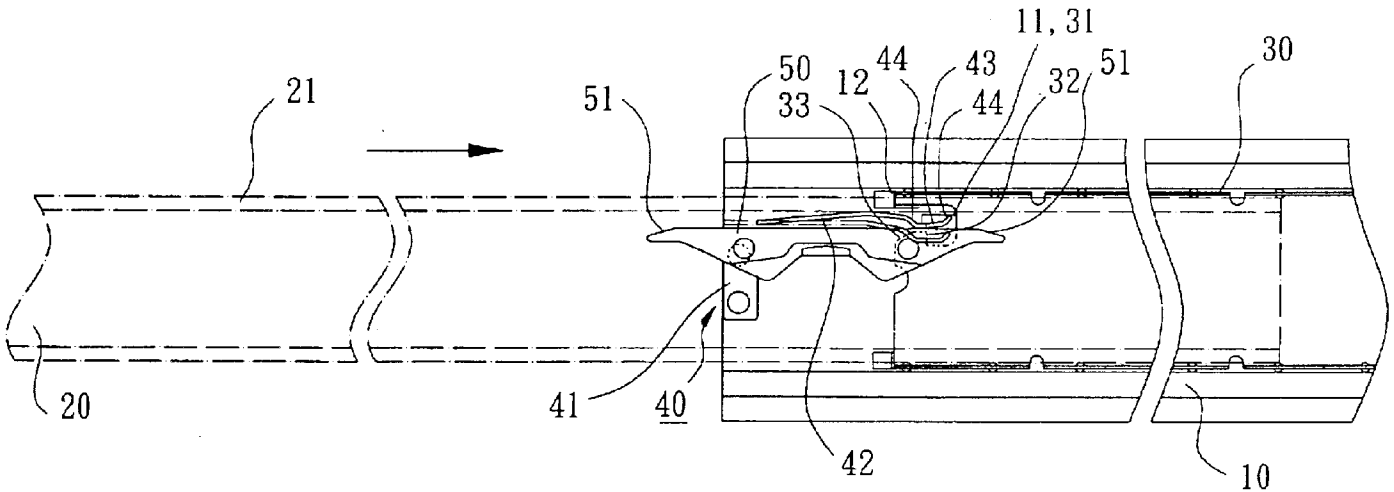
FIG. 5 is a view similar to FIG. 3, illustrating insertion of the second track into the first track of the track device in accordance with the present invention.
Figure 6:
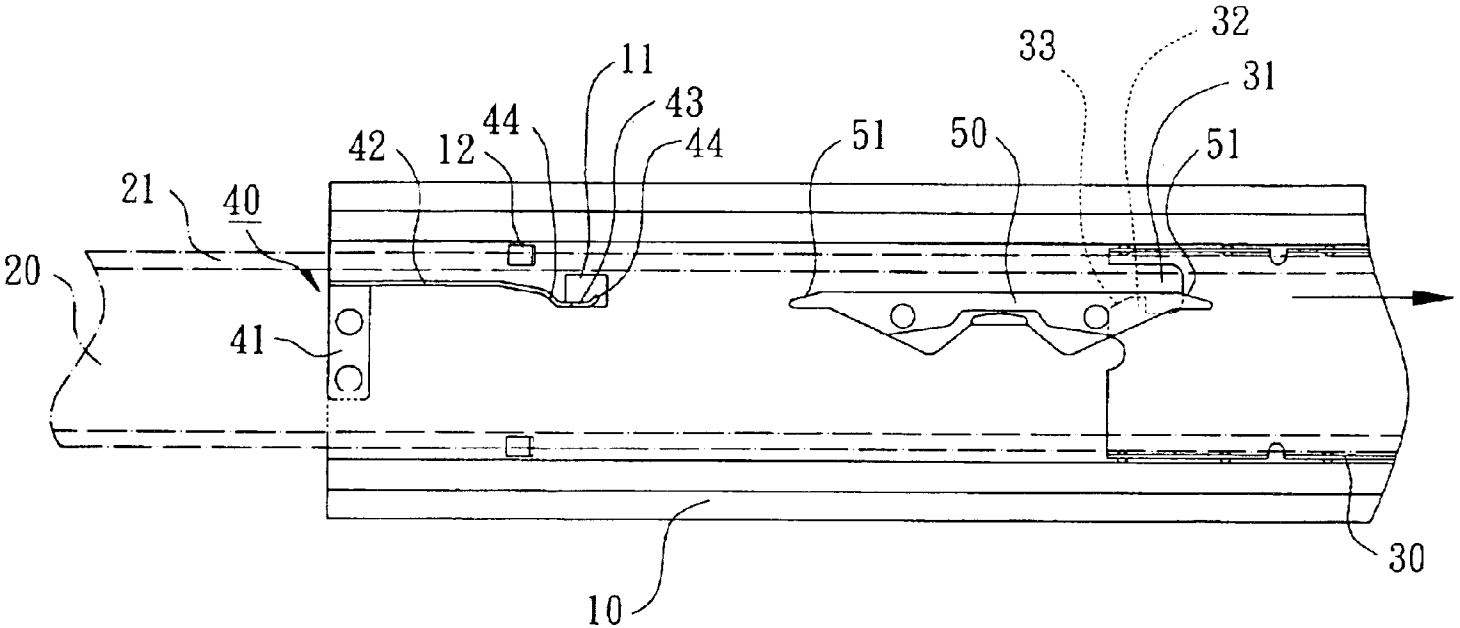
FIG. 6 is a view similar to FIG. 5, wherein the second track has been inserted into the first track.

Referring to FIGS. 5 and 6, when the second track 20 is reinserted into the first track 10, since the unlatching member 50 fixed on the second track 20 is spaced from the rear end of the second track 20 by an appropriate distance and since the slide-aiding member 30 is retained in place by the retaining member 40, the second track 20 can be precisely inserted a space between the lateral walls 35 of the slide-aiding member 30 without causing free sliding movement of the slide-aiding member 30 in the first track 10. After the second track 20 slides through a certain distance in the first track 10, the rear inclined face 51 (the right one in FIG. 5) of the unlatching member 50 comes in contact with the hook 43 of the retaining member 40 and thus imparts a force to the hook 43 of the retaining member 40 to urge the resilient hook rod 42 upward, thereby disengaging the hook 43 of the retaining member 40 from the hook 32 of the slide-aiding member 30. Thus, further inward sliding movement of the second track 20 into the first track 10 is allowed. The arrangement of the retaining member 40 and the slide-aiding member 30 in accordance with the present invention not only allows retaining of the slide-aiding member 30 during removal of the second track 20 from the first track 10 but also allows easy reinsertion of the second track 20 into the first track 10 while preventing the front end of the slide-aiding member 30 from being damaged during reinsertion of the second track 20 into the first track 10. The utility of the track device is improved and the life of the track device is prolonged.

Figure 7:
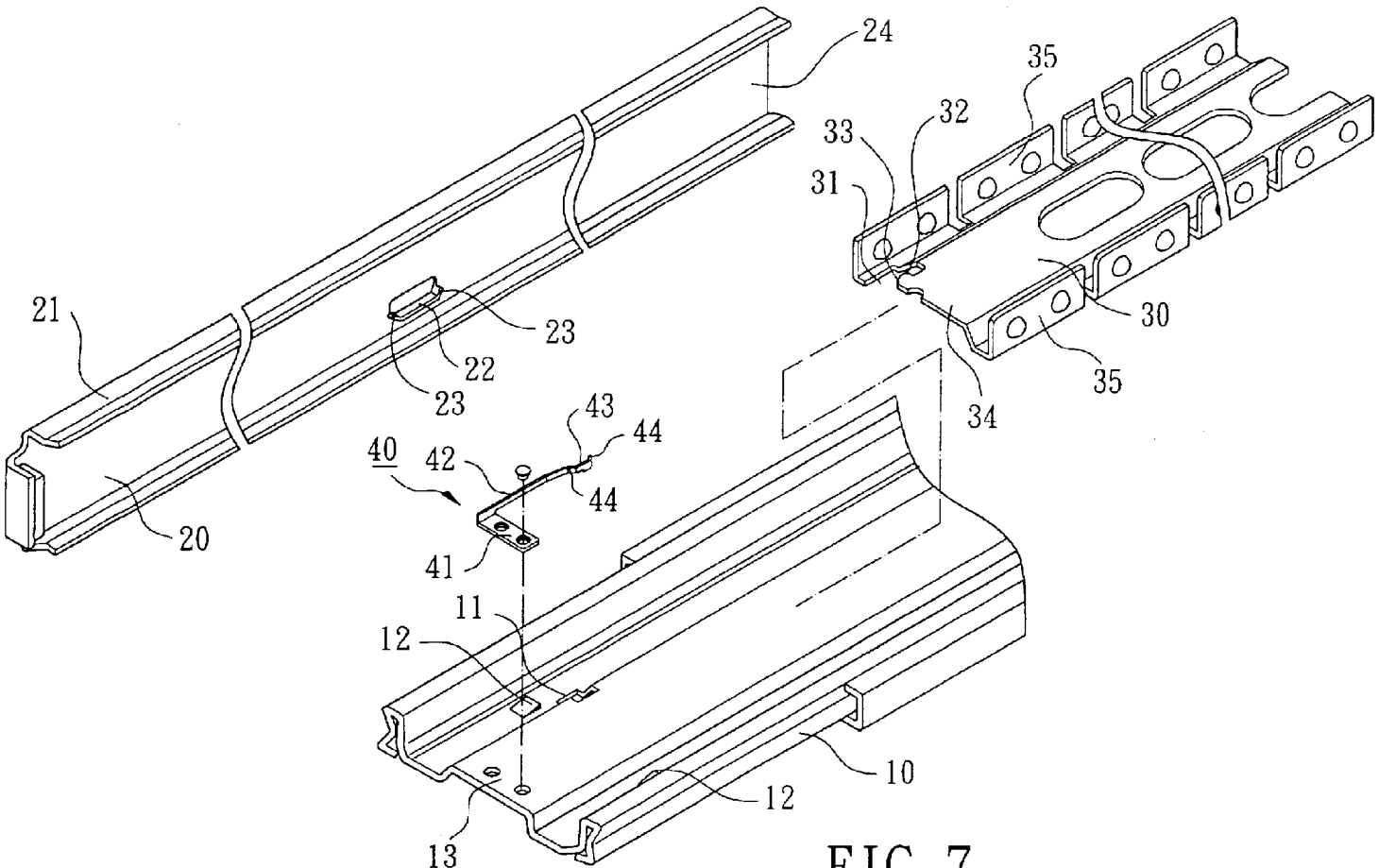
FIG. 7 is an exploded perspective view of a modified embodiment of the track device in accordance with the present invention.

FIG. 7 illustrates a modified embodiment of the invention, wherein the unlatching member (now designated by 22) is directly formed on the intermediate portion 24 of the second track 20 by means of punching. The unlatching member 22 has two inclined faces 23 on two ends thereof, with the inclined faces 23 facing away from each other. Operation of the unlatching member 22 is substantially the same as the unlatching member 50 of the embodiment of FIGS. 2 through 6.

It is appreciated that the retaining member 40, the slide-aiding member 30, and the unlatching member 22, 50 in accordance with the present invention can be readily used in two-part, three-part, or multi-part track devices for drawers.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A track device comprising:

a first track including a front end a rear end;

a second track slidably received in said first track;

a slide-aiding member mounted between said first track and said second track, allowing smooth sliding movement of said second track relative to said first track, said slide-aiding member including an engaging notch in a front end thereof;

a retaining member securely mounted on said front end of said first track and including a resilient hook rod adapted to engage with or disengage from the engaging notch for positioning or releasing the slide-aiding member with respect to the first slide track;

an unlatching member securely provided on said second track, said unlatching member adapted to actuate the resilient hook rod of the retaining member for disengaging the engaging notch from the resilient hook rod of the retaining member;

wherein when said second track is removed from said first track, said resilient hook rod of said retaining member is engaged with said engaging notch of said slide-aiding member, thereby retaining said slide-aiding member in place; and wherein when said second track is reinserted into said slide-aiding member and said first track, said unlatching member urges said resilient hook rod of said retaining member to disengage from said engaging notch of said slide-aiding member, allowing further inward sliding movement of said slide-aiding member into said first track.

2. The track device as claimed in claim 1, wherein said unlatching member is directly formed on an intermediate portion of said second track by means of punching.

3. The track device as claimed in claim 1, wherein said retaining member including a base from which said resilient hook rod extends, said base being securely fixed to an intermediate portion of said first track.

4. The track device as claimed in claim 1, wherein said resilient hook rod of said retaining member has a hook, said engaging notch of said slide-aiding member being configured to form a hook for releasably engaging with said hook of said retaining member.

5. The track device as claimed in claim 4, wherein said hook of said retaining member has two slant guide faces respectively on two ends thereof.

6. The track device as claimed in claim 5, wherein said slant guide faces face away from each other.

7. The track device as claimed in claim 5, wherein said hook of said slide-aiding member has a slant on a front end thereof.

8. The track device as claimed in claim 4, wherein said first track further includes a slot into which said hook of said retaining member extends.

9. The track device as claimed in claim 1, wherein said unlatching member includes an inclined face on a rear end thereof.

10. The track device as claimed in claim 9, wherein said unlatching member further includes another inclined face on a front end thereof.

11. The track device as claimed in claim 10, wherein said inclined face and said another inclined face of said unlatching member face away from each other.

* * * * *